US005628149A

United States Patent [19]

Kraczek

[11] Patent Number: 5,628,149

[45] Date of Patent: May 13, 1997

[54] GATE TENSIONING SYSTEM

[75] Inventor: John Kraczek, McDonough, Ga.

[73] Assignee: The Tensar Corporation, Atlanta, Ga.

[21] Appl. No.: 623,295

[22] Filed: Mar. 28, 1996

[51] Int. Cl.[6] ..... E05F 7/06

[52] U.S. Cl. ..... 49/396

[58] Field of Search ..... 49/396

[56] References Cited

U.S. PATENT DOCUMENTS

| | | | |
|---|---|---|---|
| 1,044,214 | 11/1912 | Mast | 49/396 X |
| 2,582,122 | 1/1952 | Haskett | 49/396 X |
| 2,618,876 | 11/1952 | Goode | 49/396 X |
| 2,818,294 | 12/1957 | Killough | 49/396 X |

*Primary Examiner*—Philip C. Kannan
*Attorney, Agent, or Firm*—Jacobson, Price, Holman & Stern, PLLC

[57] ABSTRACT

A gate for a fence or the like preferably formed of hollow plastic elements interconnected by bolts or other fastener devices at or adjacent their ends. A tensioning device is located inside a hollow diagonal cross-brace to correct misalignment between the vertical and horizontal elements of the gate. A removable panel on the cross-brace provides access to a turnbuckle, the ends of which are oppositely threaded to elongated steel straps or the like which are anchored, respectively, at the ends of the cross-brace to the vertical members. One end of the cross-brace is fixedly secured to one of the vertical members, the other end is slidingly received over a bolt or the like fixedly secured to the other vertical member. Rotation of the turnbuckle shortens or lengthens the tensioning device to "square" the gate with respect to the adjacent supports through which the gate swings. Small gaps are provided at the connection points to preclude binding as the gate elements are adjusted.

16 Claims, 3 Drawing Sheets

GATE TENSIONING SYSTEM

FIELD OF THE INVENTION

This invention relates to a gate for a fence or the like comprising vertical and horizontal members preferably made of polyvinylchloride (PVC) or other plastic material which includes a diagonally extending, hollow cross-brace within which a tensioning device is housed for moving the gate members into initial alignment or to correct alignment in the event that the gate becomes out of "square".

BACKGROUND OF THE INVENTION

Traditionally, wooden fences have incorporated a wooden gate to provide passage to a fenced area. Such fences and gates may be formed of pressure-treated wood and/or stained or painted to protect the wood from environmental forces and to provide an aesthetically pleasing appearance.

Regardless of the manner in which wooden fences or gates are treated over time they become "weathered". This problem can be minimized by restraining or repainting the elements every few years, but this creates an undesirable burden and cost.

Moreover, even with proper maintenance, fences and gates formed of wood eventually deteriorate. This problem is particularly troublesome in gate constructions where the screws, nails, and/or bolts keeping the elements together, loosen causing a normally square or rectangular plate to become distorted. Misalignment resulting from environmental factors is exacerbated by the cantilever effect of the heavy weight of the wooden gate elements themselves, particularly in large gates over about 36 inches wide, and the tendency of people to stand or sit on the gate and/or swing with the gate. Such misalignment may cause the gate to stick in certain positions or, if the problem is severe, prevent the gate from closing or opening.

Previously, this problem has been remedied by reinforcing or tightening the connections between the gate members and/or rehanging the gate so as to provide a correct alignment between the gate and the adjacent sideposts of a fence.

SUMMARY OF THE INVENTION

It is a primary object of the present invention to provide a gate for a fence which will maintain its appearance over time with little or no maintenance, while providing means for initial and subsequent positioning of the gate elements relative to each other so as to maintain the alignment between the gate and its adjacent support posts for correct, "true" or "square" swinging of the gate.

Thus, one important object of this invention is to provide a lightweight gate formed of plastic, such as PVC or the like, comprising a pair of vertical members and a pair of horizontal members, each of which is hollow, geometrically-shaped, perfectly square or rectangular in cross-section, and interconnected at or adjacent their corners by any conventional fastener devices to provide an assembly which maintains its structural integrity and appearance without regard to environmental deterioration.

The gate elements further include a hollow plastic cross-brace extending diagonally between the vertically extending side members of the gate. A tensioning device is housed within the cross-brace to initially "square", or to substantially correct the square of, the gate elements. By locating the tensioning device within a hollow element of the gate, an opening may be provided with a removable cover to access the operating mechanism, thereby hiding the elements from view and protecting the same from the weather and damage.

The tensioning device preferably comprises a standard turnbuckle, the ends of which are oppositely threadably connected to a pair of elongated rigid elements such as rods, strips or straps extending through the cross-brace. Since one of the vertical members of the gate is fixed by hinges or the like to a vertical post forming part of a fence section or the like, rotation of the turnbuckle causes the other vertical member of the gate to move upwardly or downwardly to thereby correct the alignment of the gate elements with respect to each other and to the adjacent fence posts on either side.

Preferably, the adjustable elements comprise a pair of one-half inch wide steel straps, the ends of which remote from the turnbuckle of which are secured about steel sleeves. One of the steel sleeves is anchored in an opening at one end of the cross-brace and additionally passes through an opening at one end of one of the vertical members of the gate. The other steel sleeve is slidably mounted in a slot formed in the opposite end of the cross-brace and is anchored in a diagonally opposite opening in the other end of the other vertical gate member.

As noted, the two steel sleeves are fixed in diagonally spaced ends of the vertical members of the gate. However, since one steel sleeve is slidably mounted in a slot of the cross-brace, a variation in the length of the tensioning device by rotation of the turnbuckle, causes the end of the cross-brace having the elongated slot to slide along the respective anchored steel sleeve. In this manner, the length of the tensioning device may be shortened by rotation of the turnbuckle in a proper direction to cause the vertical member on the side of the gate opposite to the hinges to be moved upwardly or downwardly, depending upon the diagonal orientation of the cross-brace. Likewise, lengthening of the tensioning device by opposite rotation of the turnbuckle will cause the free vertical gate member to be moved in the other direction. Thus, the elements of the gate may be manipulated to "square" the gate so as to insure proper swinging of the gate about the hinges.

To accommodate the movement of the gate elements relative to each other during adjustment, small gaps are provided in the corner connections between the horizontal cross-pieces or members and the vertical members as well as in the connections between the ends of the diagonal cross-brace and the vertical members. For example, a gap of 40 to 50 thousandths of an inch at the joints between any two members allows pivoting of the horizontal and vertical members about bolts or the like securing the gate elements at or about their corners without binding. Likewise, rotation of the cross-brace about the steel sleeves fixed in diagonally opposed openings in the vertical members is freely permitted.

It is, thus, an object of the present invention to provide a plastic gate formed of horizontal and vertical members interconnected at their corners, with a hollow diagonal cross-brace internally housing a tensioning device for shifting the orientation of the various elements with respect to each other, wherein the openings in the vertical members which receive ends of the horizontal members and the diagonal cross-brace are slightly larger than the respective elements to provide tolerance for angular movement between these elements upon adjustment of the length of the tensioning device.

These and other objects of the invention, as well as many of the attendant advantages hereof, will become more readily apparent when reference is made to the following description taken in conjunction with the accompanying drawings.

DETAILED DESCRIPTION OF THE PREFERRED EMBODIMENTS

Figure 1:
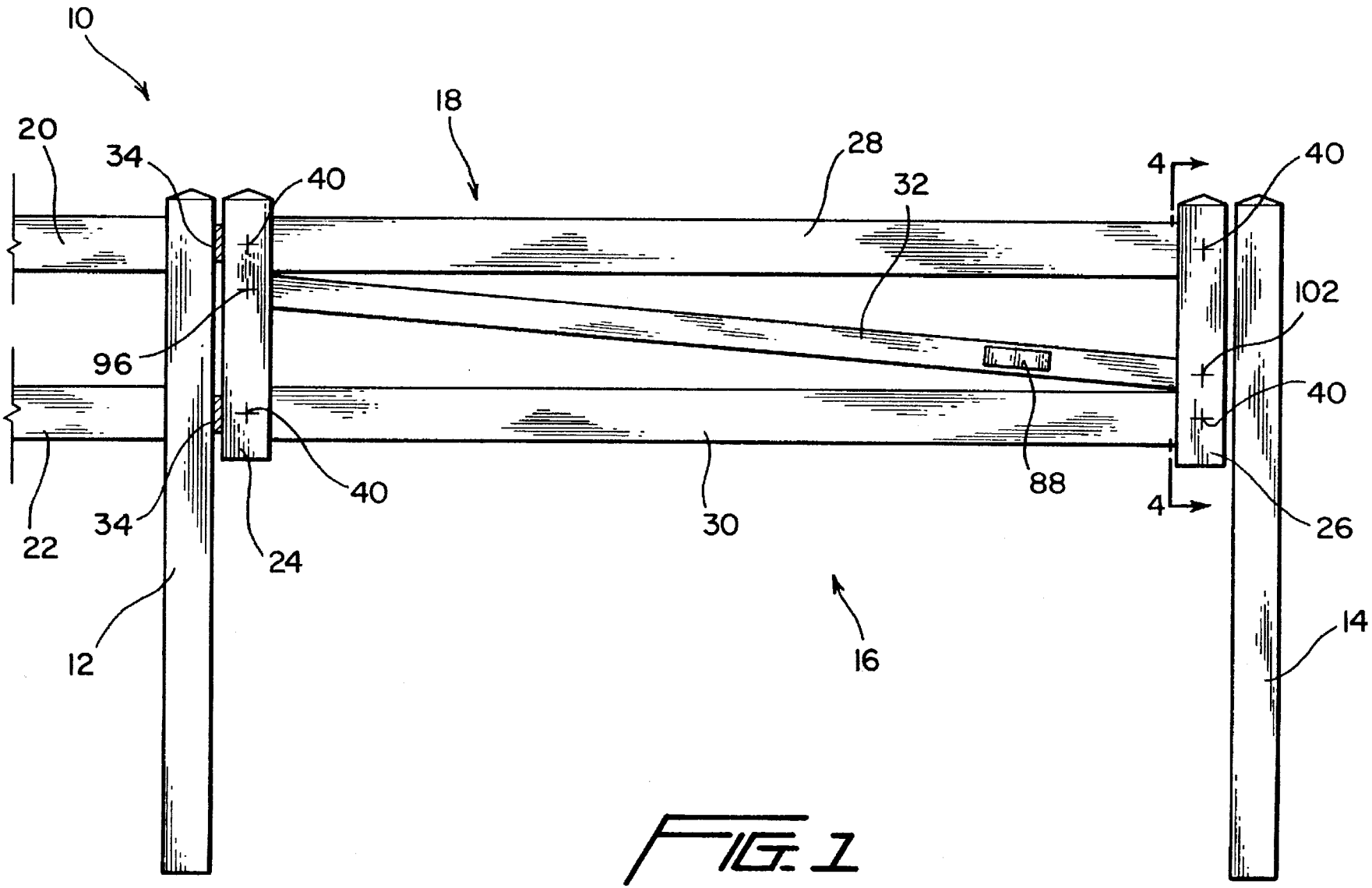
FIG. 1 is an elevational view of a portion of a fence with a gate according to this invention spanning an opening formed between parallel fence posts anchored in the ground at the ends of adjacent fence sections.

In describing a preferred embodiment of the invention illustrated in the drawings, specific terminology will be resorted to for the sake of clarity. However, the invention is not intended to be limited to the Specific terms so selected, and it is to be understood that each specific term includes all technical equivalents which operate in a similar manner to accomplish a similar purpose.

With reference to the drawings, in general, and to FIG. 1, in particular, a fence embodying the teachings of the instant invention is designated generally by the reference numeral 10. The fence 10 includes two parallel, generally vertically extending, fence posts 12, 14 which extend into the ground and define an opening 16 therebetween selectively closed by a hingedly mounted gate 18.

It is to be understood that, although the instant invention is shown and referred to as a "gate", mounted for swinging movement between fence posts at the ends of a pair of fence sections, similar concepts are applicable to a door or other device wherein the elements may tend to become misaligned. Likewise, the opening need not be formed by a pair of spaced fence sections; rather, the "gate" can be hingedly secured to any fixed element for swinging movement relative thereto.

However, in the preferred use of the instant inventive concepts, the gate 18 is Dart of a fence assembly comprising the fence POSTS 12, 14 and a plurality of horizontally extending beams, two of which are illustratively shown at 20, 22, with vertically extending pickets (not shown) to form a typical fence pattern.

The Gate 18 comprises a pair of parallel, generally vertically extending, side members 24, 26 interconnected with a pair of parallel, Generally horizontally extending, upper and lower members 28, 30. A cross-brace 32 extends diagonally between the vertical members 24, 26 intermediate the horizontal members 28, 30. As is common, one of the vertical members of the gate 18, in this example, member 24, is pivotally secured as by hinges 34 to one of the fence posts 12, for swinging movement of the gate 18 through the opening 16.

Figure 4:
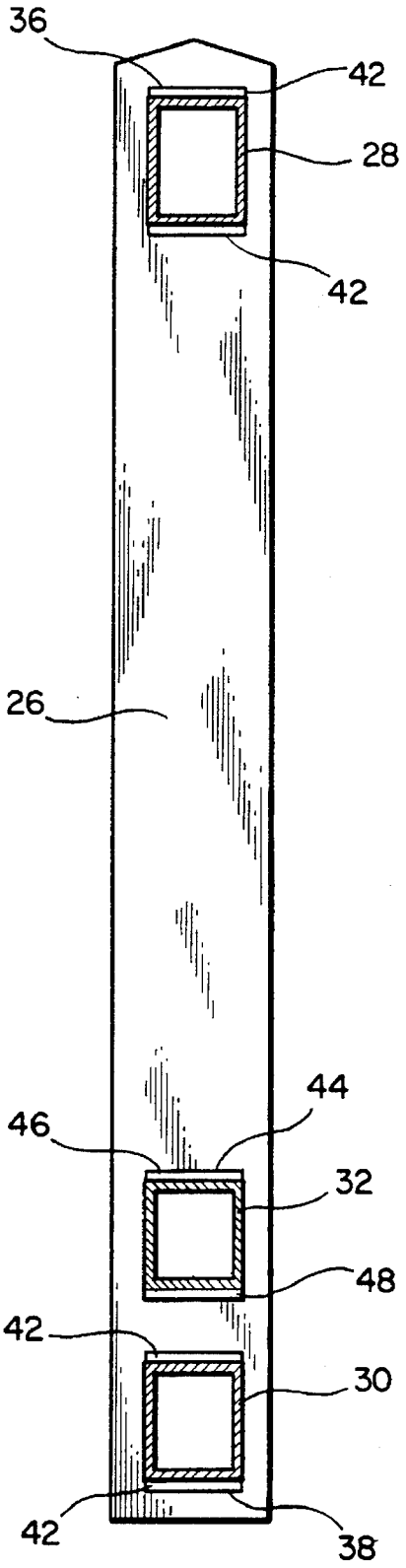
FIG. 4 is an enlarged sectional view taken along line 4—4 of FIG. 1 to illustrate the passage of the ends of the two horizontal members and the diagonal cross-brace into the vertical gate members, with small gaps provided to allow for a shifting of these elements when they are being squared.

According to the preferred embodiments of this invention, all elements of the fence assembly, including the fence posts 12, 14, the beams 20, 22 and the pickets (not shown) are formed of a plastic material such as PVC. Most importantly, however, the elements of the gate 18, including the vertical members 24, 26, the horizontal members 28, 20, and the diagonal cross-brace 32 are elongated extruded plastic, hollow elements, preferably square or rectangular in cross-section. To assemble the gate, the horizontal members 28, 30 are inserted through openings 36, 38 adjacent the top and bottom of the vertical members 24, 26, respectively. In FIG. 4, only vertical member 26 is shown; however, it is understood that vertical member 24 is of a similar construction, except with respect to the engagement of cross-brace 32. With the ends of the horizontal members 28, 30 inserted into the openings 36, 38 in the vertical members 24, 26, a bolt and nut or any other conventional means, as represented by the "+" indicators at connection points 40 in FIG. 1, are provided to secure the elements together.

Figure 2:
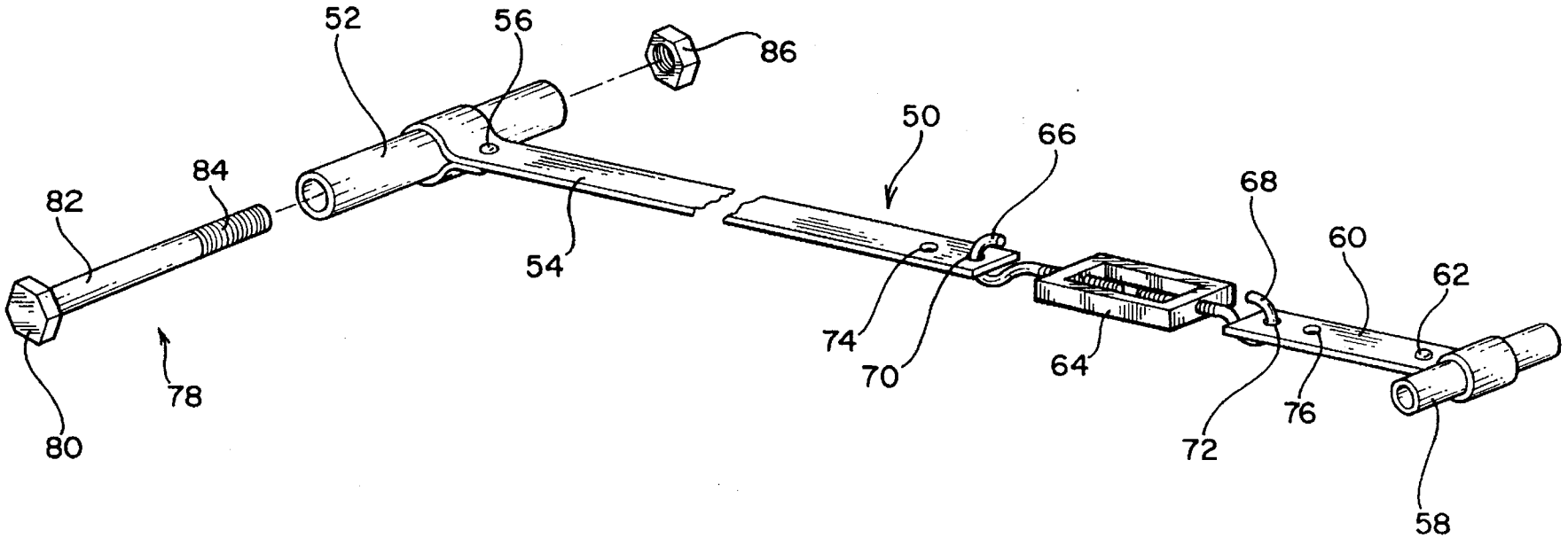
FIG. 2 is a perspective, partially exploded, view of a tensioning device to be located within the diagonal cross-brace of the gate shown in FIG. 1.

As seen particularly in FIG. 4, each of the openings 36, 38 are slightly latter in a vertical direction than the height or the horizontal members 28, 30 to provide small gaps 42. The gaps 42 in each of the openings are on the order of about 40 to 50 thousandths of an inch for a purpose to be explained in more detail hereinafter with reference to FIGS. 2 and 3.

Similarly, openings are provided in the vertical members 24, 26 to receive the opposite ends of the diagonal cross-brace 32. In FIG. 4, an opening 44 is shown adjacent to the lower opening 38 in the vertical member 26; the opening (not shown) in post 24, which receives the opposite end of the cross-brace 32 is adjacent to the upper opening 36 thereof because of the diagonal orientation of the cross-brace 32.

The openings in the posts 24, 26 which receive the ends of the cross-brace 32 are also slightly larger than the cross-section through the angled cross-brace to provide upper and lower gaps 46, 48. In FIG. 4, due to the inclined orientation of the cross-brace, a portion of the exterior lower surface of the cross-brace is seen in the gap 48.

According to the primary object of this invention, a tensioning device 50 is located inside the hollow cross-brace 32 to align or "square" the elements of the gate 18. The tensioning device 50 comprises basically a turnbuckle 64 oppositely threaded to a pair of elongated elements shown as steel straps 54, 60. One end of each strap 54, 60 is secured to itself by a rivet 56, 62 or by welding to form a loop within which a steel sleeve 52, 58 is slidably mounted.

The inner ends of the straps 54, 60 are provided with a pair of spaced openings 70, 74 and 72, 76, one of each pair being engaged by hooks 66, 68. The nooks 66, 68 have threaded ends which are received in oppositely Threaded portions of the turnbuckle 64 in a well known manner so that, upon rotation of the turnbuckle 64 in one direction, the hooks 66, 68 will draw the steel straps 54, 60 towards each other to shorten the tensioning device 50, while rotation of the turnbuckle 64 in the opposite direction will further separate the steel straps 54, 60 and lengthen the tensioning device 50. The provision of a pair of openings on each strap enables a gross length adjustment of the tensioning device 50, if necessary.

Access to the turnbuckle 64 for adjustment of the length of the tensioning device 50 is provided through an opening 90 in the side wall of the cross-brace 32 closed by a snap-fit cover plate 88 for aesthetic and safety reasons.

The tensioning device 50 is fixedly secured at 96 to the vertical member 24 by passing the sleeve 52 pass through an opening 92 in the end 94 of the cross-brace 32. A bolt 78 or the like is engaged through a complementary opening (not shown) in the vertical member 24, with the head 80 of the bolt 78 engaging one side of the vertical member 24 and a nut 86 engaging the other side to secure the sleeve 52 to the vertical member 24 and the end 94 of the brace 32.

Figure 3:
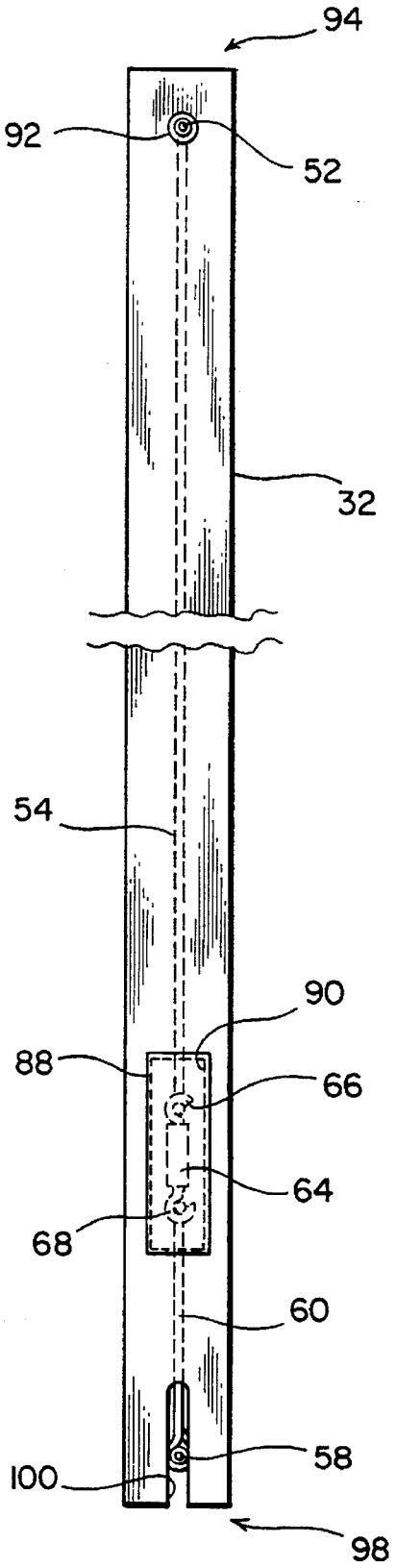
FIG. 3 is an enlarged elevational view of the diagonal cross-brace, with hidden portions of the tensioning device contained therein shown in dotted lines.

An elongated slot I00 is provided at the opposite end 98 of the brace 32 for slidable reception of the sleeve 58. It is understood that the elongated slot 100 could be closed at both its ends rather than open at one end as shown in FIG. 3. The sleeve 58 is secured at 102 in the vertical member 26 by a bolt or the like (not shown).

If, for some reason, the alignment of the gate 18 is improper and the upper end of the vertical member 26, for example, is contacting the fence post 14, the cover plate 88 may be removed and the turnbuckle 64 rotated to draw the straps 54, 60 towards each ether to thereby shorten the tensioning device 50. Since the sleeves 52, 58 are anchored in the side walls of the vertical members 24, 26, respectively, the shortening of the tensioning device 50 will cause the end 98 of the cross-brace 32 to slide along the sleeve 5S guided by the slot 100, while the opposite end 94 will pivot around sleeve 52, thereby raising the lower end of the vertical member 26 and "squaring" the gate 18.

In a similar manner, the turnbuckle 64 may be rotated in an opposite direction to lengthen the tensioning device 50 if the lower end of the vertical member 26 is contacting the fence post 14, again "squaring" the gate To accommodate the movement of the sleeve 58 along the slot 100 produced by rotation of the turnbuckle 64, the gaps 42 will permit the engagement of the horizontal members 28, 30 with the vertical members 24, 26 to shift slightly about their connection points 40 without binding. Likewise, the gaps 46, 48 in the openings in the vertical members 24, 26 that receive the ends 94, 96 respectively of the brace 32 accommodate slight movement in these connections. A gap in the opening between the horizontal members 28, 30 and the vertical members 24, 26 of about 40 thousandths of an inch will allow elevational adjustment of the free end of the gate 18 by approximately one inch. Accordingly, if additional adjustment of the gate is contemplated, a larger gap size can be included in the criminal gate assembly.

After adjustment of the gate 18, the cover plate 88 can be snapped back over the opening 90 to prevent exposure of the tensioning device 50 to the elements. In this manner, a weather-proof gate having a pleasing aesthetic appearance can be maintained in use for many years with only occasional minor adjustments.

Although the gate elements are described herein and in the accompanying claims as generally horizontally extending or generally vertically extending, it is to be understood that these terms are relative and the gate can be mounted in any orientation, including angled. Similarly, although the cross-brace is seen as extending diagonally downwardly from the upper end of the hinged vertical member of the gate to the lower end of the free vertical member, the inclination can be reversed, and the diagonal brace can even extend between the horizontal members of the gate, rather than the vertical members.

thus, the foregoing description should be considered as illustrative only of the principles of the invention. Since numerous other modifications and changes will readily occur to those skilled in the art, it is not desired to limit the invention to the exact construction and operation shown and described, and, accordingly, all suitable modifications and equivalents may be resorted to, without departing from the scope of this invention.

I claim:

1. A gate comprising:

a pair of generally vertically extending members;

a pair of generally horizontally extending members, said vertical and horizontal members being interconnected adjacent their ends to form a quadrilateral frame, a cross-brace diagonally interconnecting two opposed members of said frame, said cross-brace being hollow, and a tensioning device located within said cross-brace for adjusting the orientation of said vertical and horizontal members with respect to each other, said tensioning device including a pair of sleeves anchored, respectively, to said two opposed members, and a turnbuckle connected to said two sleeves by rigid elements for movement of said sleeve with respect to each other upon rotation of said turnbuckle to thereby change length of said tensioning device movement of said sleeves device.

2. A gate according to claim 1, wherein said vertical and horizontal members are also hollow.

3. A gate according to claim 2, wherein said vertical and horizontal members and said cross-brace are formed of plastic material.

4. A gate according to claim 1, wherein said rigid elements comprise steel strap members interconnecting each sleeve with said turnbuckle.

5. A gate according to claim 1, wherein one end of said cross-brace is fixedly secured to one of said sleeves, the other end of said cross-brace being slotted and being slidingly received over the other of said sleeves.

6. A gate according to claim 1, wherein end portions of said horizontal members and said cross-brace are slidingly received in openings in said vertical members, and said openings being slightly larger in vertical dimension than the height of the element received therein to provide small gaps therebetween.

7. A gate according to claim 1, further including an opening in said cross-brace to access said turnbuckle, and a cover for said opening.

8. A gate according to claim 1, wherein said sleeve are anchored, respectively, to said vertical members.

9. A fencing system comprising:

at least two sections of fencing defining an opening therebetween;

a gate pivotally mounted on one of said sections of fencing and spanning said opening;

said gate including:

a pair of generally vertically extending members;

a pair of generally horizontally extending members, said vertical and horizontal members being interconnected adjacent their ends to form a guadrilateral frame, a cross-brace diagonally interconnecting two opposed members of said frame, said cross-brace being hollow, and a tensioning device located within said cross-brace for adjusting the orientation of said vertical and horizontal with respect to each other, said tensioning device including a pair of sleeves anchored, respectively, to said two opposed members, and a turnbuckle connected to said two sleeves by rigid elements for movement of said sleeve with respect to each other upon rotation of said turnbuckle to thereby change length of said tensioning device.

10. A fencing system according to claim 9, wherein said vertical and horizontal members are also hollow.

11. A fencing system according to claim 10, wherein said vertical and horizontal members and said cross-brace are formed of plastic material.

12. A fencing system according to claim 11, wherein said sections of fencing are formed of plastic.

13. A fencing system according to claim 9, wherein said rigid elements comprise steel strap members interconnecting each sleeve with said turnbuckle.

14. A fencening system according to claim 9, wherein end portion of said horzontal member and said cross-brace are slidingly received in opening in said vertical members, and said opening being slightly lager in vertical dimension than the height of the element received therein to provide small gaps therebetween.

15. A fencing system according to claim 9, further including an opening in said cross-brace to access said turnbuckle, and a cover for said opening.

16. A fencing system according to claim 9, wherein said sleeves are anchored, respectively, to said vertical members.

* * * * *